455-73 SR
3/20/84 XR 4,438,429

United States Patent [19]

Park

[11] 4,438,429

[45] Mar. 20, 1984

[54] EMERGENCY SIGNAL TRANSCEIVER FOR DISABLED CAR

[76] Inventor: Seung M. Park, 210-29 Itaewon-dong, Yongsan-ku, Seoul, Rep. of Korea

[21] Appl. No.: 308,907

[22] Filed: Oct. 5, 1981

[51] Int. Cl.[3] ..... G08B 1/08

[52] U.S. Cl. ..... 340/539; 340/901; 340/933; 455/9; 455/11; 455/73; 455/228

[58] Field of Search ..... 340/539, 31 R, 32, 33, 340/34; 343/6.8 R; 455/9, 11, 73, 89, 227, 228

[56] References Cited

U.S. PATENT DOCUMENTS

| | | | |
|---|---|---|---|
| 3,293,600 | 12/1966 | Gifft | 340/33 |
| 3,441,858 | 4/1969 | Graham | 340/33 |
| 3,532,986 | 10/1970 | Gelushia et al. | 340/33 |

*Primary Examiner*—Donnie Lee Crosland
*Attorney, Agent, or Firm*—Armstrong, Nikaido, Marmelstein & Kubovcik

[57] ABSTRACT

An emergency signal transceiver for a disabled vehicle for generating a repetitive pulse signal, digital apparatus for producing a pulse signal from such a received repetitive pulse signal for actuating buzzer and light alarm displays, apparatus for alternatively switching the pulse signal generator to provide input to a transmitter and the digital apparatus to derive the output of a receiver.

6 Claims, 3 Drawing Figures

| A | B | C | D | Y |
|---|---|---|---|---|
| 0 | 0 | 0 | 0 | 1 |
| 1 | 0 | 0 | 0 | 1 |
| 0 | 1 | 0 | 0 | 1 |
| 0 | 0 | 1 | 0 | 1 |
| 0 | 0 | 0 | 1 | 1 |
| 1 | 1 | 0 | 0 | 1 |
| | | | | |
| | | | | |
| 1 | 1 | 1 | 1 | 0 |

EMERGENCY SIGNAL TRANSCEIVER FOR DISABLED CAR

BACKGROUND OF THE INVENTION

The present invention relates to an emergency signal transceiver for disabled cars. It is particularly necessary when a vehicular accident takes place on an expressway or on a road with uncertain visibility, to immediately inform all vehicles approaching the disabled car to prevent further chain accidents. Therefore, it is usual to put a danger signal device at the rear of the troubled car to make its presence known to other cars but this is found inadequate to give a timely danger signal and it is difficult to expect the signal to function adequately in fog or on a winding road surface along a valley because of the disabled car being hidden from sight in such terrains.

An object of this present invention is designed to prevent further accidents beforehand by speedily making the disabled car known to other approaching cars regardless of sight hindrance. In other words, the present invention is a device to equip all motor vehicles with a transceiver to make the car in accident or in trouble known to its surrounding and other approaching cars by a special signal to be detected on the receiver of an approaching vehicle when an electric signal is transmitted from the car in accident or in trouble.

This type of danger signal always requires a reliable identification as such signal is bound to cause the driver to be under tense attention. Thus, if such danger signal is detected on a running vehicle by radio waves which occur constantly in the engine or other parts of a vehicle, this will cause the driver to be under an unnecessary tension and lower the reliability of the warning device of danger signal. This unreliable danger signal warning device may rather result in causing accidents. For this reason, it is necessary to have a danger warning apparatus which is capable of giving prompt warning by a transceiver with high reliability under a running vehicular condition. The present invention meets this need.

SUMMARY OF THE INVENTION

The objects and advantages of the present invention are provided by a digital circuit for receiving and sending an alarm signal in conjunction with a radio transceiver installed in a vehicle.

A circuit for receiving the alarm signal comprises a comparator and associated AGC circuit for providing the reference level for the comparator a first multivibrator (MV) connected to the comparator, a counter connected to the comparator, and to the first multivibrator (MV) a reset inverter for resetting the counter, a NAND gate connected to receive the counter outputs, a second MV to produce a pulse from the NAND gate output and indicating means to indicate by a buzzer or a lamp when the second MV produces a signal.

A second circuit is provided to generate an alarm signal comprising a repetitive series of digital pulses.

Switching means are provided to selectively connect the second circuit to the transmitter or to connect the receiver to the first circuit.

DETAILED DESCRIPTION OF THE INVENTION

Figure 1:
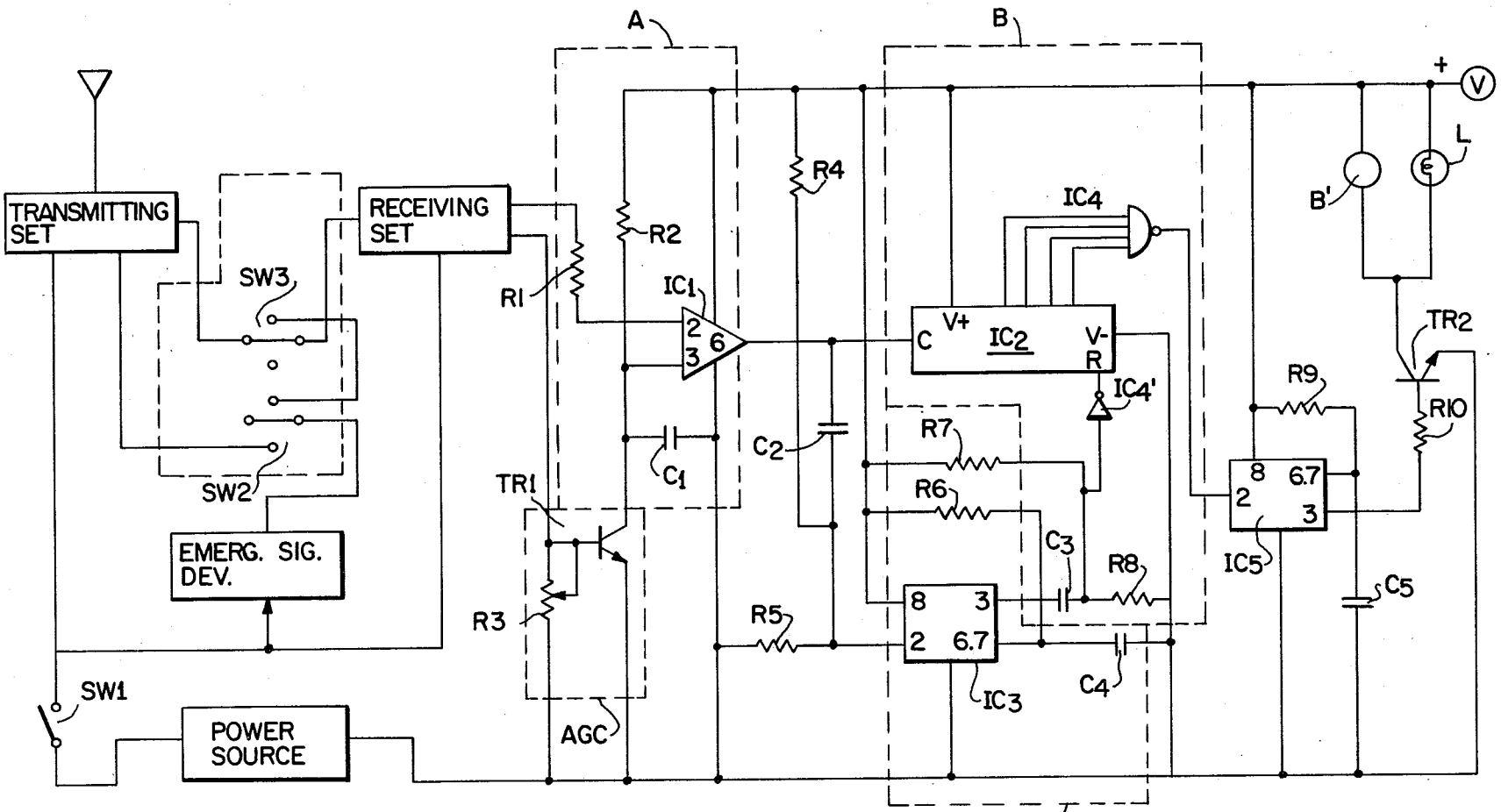
FIG. 1 is a circuit diagram of an embodiment of the invention.

A moving vehicle is equipped with a modified transceiver to detect the radio waves emitted by the similarly equipped transceiver of a car which has been in an accident or is in trouble. The transceiver is capable of detecting the voltage of an automatic gain control circuit at the receiving set by signal comparator (A) and of reducing noise by automatically comparing noise level with the received signal. The device also actuates endpoint items such as a buzzer or lamp with error signals of vehicles by actuaing a one-shot multivibrator (C) with a digital device (B).

Circuit changing switches (SW2 & SW3) at the transmitting set and the receiving set are mutually linked with each other, and these switches respectively connect the input terminals (No. 2 & No. 3) of the signal comparator (A) by contacting the base of transistor (TR1) connected to variable resistor (R3) which adjusts the voltage of the automatic gain control and resistor (R1) of output from the receiving set and by linking the collector with resistor (R2).

Thus, when a pulse-signal danger signal is received, the AGC circuit and the comparator IC1 derive the pulse signal output from the receiving set. The AGC circuit's gain is adjusted to a level which prevents the noise level from producing false alarm signals. Terminal No. 6 of IC1 output couples with resistors (R4 & R5) through the terminal (C) of counter (IC2) and coupling condenser (C2) and also is connected with the trigger terminal (No. 2) of IC3. Thus, when a series of N pulses occur through the input of the NAND gate of IC4 from the output of the counter (IC2), the device is activated.

The time setting at IC3 connects Resistor (R6) one side of condenser (C4) with input terminals (No. 6 and No. 7). Also, the resetting terminal (R) of the counter is connected through the inverter (IC4') with the junction of resistors R7, R8 and condensor (C3), which is also connected to terminal No. 3 of multivibrator IC3.

Then the output of NAND gate IC4 is connected with No. 2 terminal of one-shot multivibrator IC5 and the time setter circuit connects the junction of resistor R9 and condenser C5 with the input terminals (No. 6 and No. 7) of IC5, and the output of IC5 is taken from terminal No. 3 and applied to the base of transistor (TR2) through the resistor R10. Thus, a buzzer (B') and a lamp (L) are connected with this transistor.

SW1 is a power source switch.

The applicable effect of this invention is as given below. For the transmitting and receiving sets, emergency signal device, signal comparator (A) and the driving circuit of the lamp (L) and buzzer by means of digital control, conventional circuits have been used. An emergency signal device that modulates a specific band of frequency is attached to the transmitting set. Therefore, when a car is in trouble, an emergency signal on a specific band of frequency is transmitted by actuating this device into motion.

The emergency signal device (Emerg. Sig. device) is a circuit for generating the repetitive series of spaced pulses labelled "Digital signal" in FIG. 2 to be applied to the transmitting set for transmission as an alarm signal when the vehicle carrying this particular transceiver is disabled.

As shown in FIG. 1, transmitting and receiving emergency signals and their automatic testing fucation are described as below. SW1 is the power source switch and SW2 and SW3 are three-stage interlocking switches, the first space of which is for automatic testing, the second stage for the receiving condition, and the third stage for the transmitting condition.

The automatic testing at the first stage has the function of confirming if there is any abnormal condition with this device and emergency signal at this stage is connected with terminal No. 1 at the central terminal of SW2. Then, the signal is connected to the central terminal from terminal No. 1 of SW3 to become the signal input of the receiving set and is tested in the same manner at the time of receiving emergency signals.

The receiving condition of the 2nd stage switch takes a small emergency signal that arrives at the antenna of the receiving set as an input of the receiving set connected to the central terminal No. 2 of SW3, and this input is amplified to detect the emergency signal from the signal comparator to activate the said buzzer and lamp to make the state of emergency known. The transmission of the third stage switch is to make the state of emergency known by radiating from the antenna the input of signal modulation at the transmitting set in connection with terminal No. 3 of SW2 which links the signal from the emergency signal device with the transmitting set.

The choice of this radiation radio wave input and frequency band should be made by selecting such frequencies as assigned to the Citizen band and the output also should be within the intensity of electric field that conforms to the Radio Wave Control Law. Therefore, the radiated signal band should be such as to be known to the running vehicles and be emitted to a distance forward and backward sufficient for the insurance of safety.

Thus, this transmitted signal of emergency is received by other vehicles, amplified by the receiving set and then connected to the input terminal No. 2 of the signal comparator (IC1), the noise level of the input signal being selected by adjusting the voltage of automatic gain control (AGC) from the receiving set for input terminal No. 3 with the variable resistor (R3). The transistor (TR1) and resistor (R3) operate so that a signal of a noise level higher than that selected may remain at terminal No. 2 of to be compared and detected at IC1. Then this detected output is coupled as a digital signal to the clock input (C) of IC2 at the counter (B).

Figure 2:
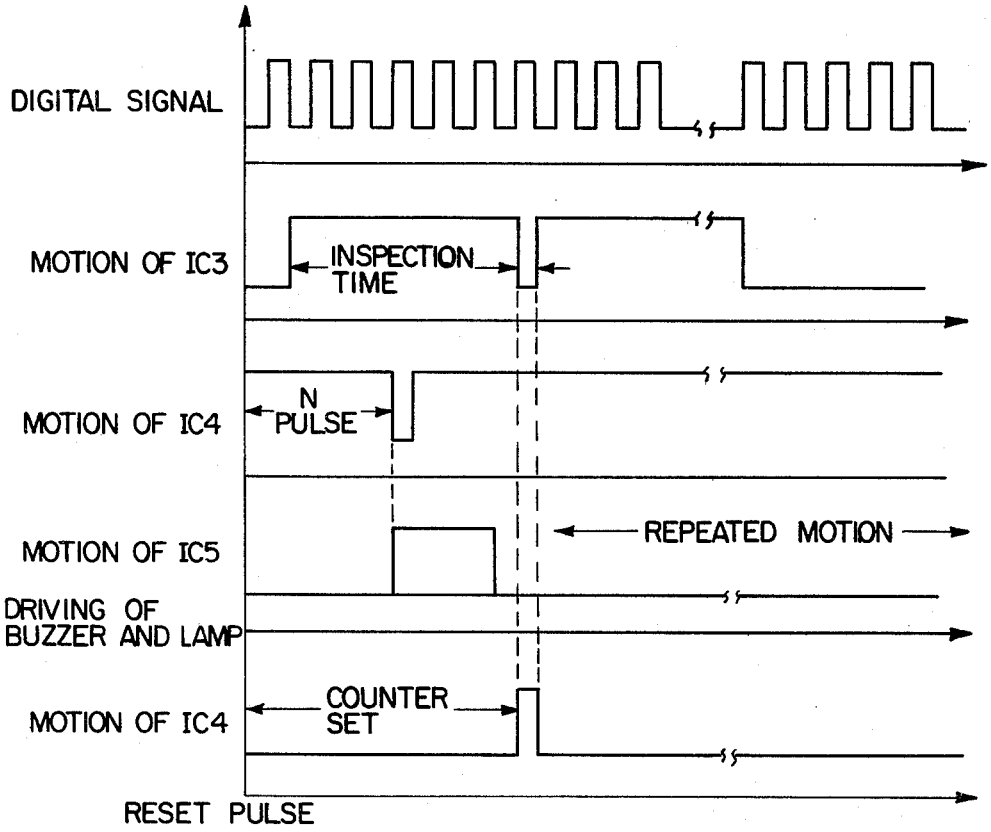
FIG. 2 is a set of wave diagrams showing waveforms at different locations of the circuit of FIG. 1.
Figure 3:
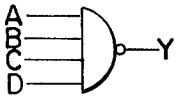
FIG. 3 shows a truth table for a NAND gate.

Explanation is as given below on the waveforms from digital input signal in accordance with the waveform chart in FIG. 2 and FIG. 3 of the truth table. The truth table shows operation of the NAND gate for as much as four inputs, although as few as two inputs may be employed.

When a series of N-received digital pulses are counted at the counter (B), the NAND gate IC4 is activated by passing a digital signal pulse and the output of IC3 to the gate to provide output of the truth table. The NAND gate output triggers the one-shot multivibrator (IC5). Then the IC5 output pulse (the lined portion in FIG. 2) is established by the time constant of resistor (R9) and the condenser (C5) for the time period shown.

The output signal derived from the output terminal (3) of IC5 is taken as a base input of transistor (TR2) through the electric current restriction resistor (R10) and repeatedly activates the emergency lamp (L) and buzzer (B') by causing electric current flow into the collector. This repeated activation indicates reception of a band frequency continuously developed by modulation signal from the generator of the transmitted signal emitted from the car in accident or in trouble. Therefore, if the digital numbers at IC2 continue to be the series of N pulses, this will activate IC4 and then IC5 and TR2 will be activated thereby. Thus, the Buzzer (B') and lamp (L) will be repeatedly actuated motion. In this manner, the blinking time of the buzzer and lamp depends on the selection of the set pulse of IC2 counter set.

Also, IC3 which consists of a one-shot multivibrator has the function of inspecting (sampling) the received signal only for a given time and connects the contact portions of resistor (R4) and resistor (R5) with the signal comparator (IC1) output signal through coupling condenser (C2) and is triggered at the same time with the counter-clock input of the counter at the trigger terminal (2), establishing its time constant by means of resistor (R6) and condenser (C4).

The output signal being derived from the output terminal (3) is coupled as an input to the counter reset terminal R after inverting it in inverter (IC4), coming through the coupling condenser (C3). When the count goes wrong because of the inflow of noise while receiving signals, the emergency lamp and buzzer are not activated at the time when the indicated number of digital pulses is lower than the preset number, in which case, the signals counted lower than the set number, repeats the action of resetting. Under such circumstance, neither buzzer nor lamp is activated.

Therefore, the buzzer (B') and lamp (L) are activated only by the transmitted signals having more than a given number (N) of pulses. As stated in the foregoing, the present invention, as it is to send signals of emergency through the buzzer and lamp to approaching vehicles' receivers, is capable of conveying promptly danger signals regardless of sight hindrance. In this manner, the present invention is designed to prevent accidents of all vehicular traffic beforehand.

What is claimed:

1. An emergency alarm system for a vehicular radio transceiver having a transmitter unit, a receiver unit and an antenna comprising:

comparator means for deriving as an input from said receiver a repetitive series of digital pulses;

automatic gain control means, connected to receive the output signal of said receiver, to adjust the noise level of the output signal and to couple the adjusted signal to the comparator means as a reference level input signal;

first multivibrator means coupled to receive the output of said comparator means as an input and to provide a series of pulse signals of predetermined duration as an output signal;

counter means, coupled to receive as inputs the output of said comparator means and the output of said first multivibrator means, for counting the output pulses from said comparator means to determine when a preselected number of pulses has been received and for passing a digital pulse and the output pulse of said first multivibrator to a pair of its output terminals at this time;

NAND gate means for receiving the outputs of said counter and providing an output signal therefrom;

second multivibrator means for providing a pulse output in response to the output signal of said NAND gate;

driver means, to which the output of said second multivibrator is coupled, for increasing the power of its input signal;

indicating means for receiving the output pulse signal of said driver means and for providing an external indication of its reception of a pulse signal.

2. A system as in claim 1 wherein said indicating means comprises a lamp.

3. A system as in claim 1 wherein said indicating means comprises a buzzer.

4. A system as in claim 1 further including:

signal generating means connected to said transmitter for generating a repetitive series of digital pulses, and switching means for selectively switching said signal generating means to said transmitter unit or said receiver unit to said antenna.

5. An emergency alarm system for a vehicular radio transmitter having a transmitter unit, a receiver unit and an antenna comprising:

a comparator connected to the receiver output for receiving an alarm signal comprising a repetitive series of digital pulses;

an automatic gain control circuit connected to the receiver output and a comparator input for providing a reference level signal to the comparator;

a first multivibrator (MV) connected to the comparator output;

a counter connected to the outputs of the comparator and the first MV;

a NAND gate connected to the outputs of the counter to receive a pair of output signals when the counter has counted a preselected number of said digital pulses;

a second multivibrator (MV) connected to said NAND gate and producing a pulse in respone to a NAND gate output signal;

a driver transistor connected to said NAND gate; and indicating means connected to said driver transistor for producing an indication of the existence of an output signal from said driver transistor.

6. A system as in claim 5 further including:

a signal generating circuit for producing a repetitive series of digital pulses; and switching means for selectively connecting said signal generating circuit to said transmitter or said receiver to said antenna.

* * * * *